US006084532A

United States Patent [19]

Prieto et al.

[11] Patent Number: 6,084,532

[45] Date of Patent: Jul. 4, 2000

[54] SYSTEM FOR THE CONTROL AND MONITORING OF LIGHT VEHICLE TRANSIT IN PUBLIC CAR PARKS

[75] Inventors: Javier Riesco Prieto; Pablo Riesco Prieto, both of Madrid, Spain

[73] Assignee: Quality Information Systems, S.A., Madrid, Spain

[21] Appl. No.: 09/170,113

[22] Filed: Oct. 13, 1998

[30] Foreign Application Priority Data

Oct. 13, 1997 [ES] Spain ..... 9702119/9

[51] Int. Cl.[7] ..... G08G 1/01

[52] U.S. Cl. ..... 340/933; 340/932.2; 340/937; 235/384

[58] Field of Search ..... 340/933, 932.2, 340/937; 235/382, 384

[56] References Cited

U.S. PATENT DOCUMENTS 5,877,969 3/1999 Gerber ..... 364/562

*Primary Examiner*—Daryl Pope

*Attorney, Agent, or Firm*—Dennison, Scheiner, Schultz & Wakeman

[57] ABSTRACT

TRANSIT IN PUBLIC CAR PARKS, including the installation of software and hardware that processes and records, after automatic or manual capturing, the registration number of the vehicles, associating it by computer with the ticket code or number. It is applicable in public car parks for light vehicles.

8 Claims, 3 Drawing Sheets

SYSTEM FOR THE CONTROL AND MONITORING OF LIGHT VEHICLE TRANSIT IN PUBLIC CAR PARKS

BACKGROUND OF THE INVENTION

1. Field of the Invention

The present invention is directed toward a method and system for controlling and monitoring vehicles, and more specifically, toward a system and method for the computerized control and monitoring of vehicles in public car parks.

To prevent vehicle theft.

To prevent fraud on the part of users.

To facilitate the resolution of users' claims.

To resolve problems due to users' carelessness.

To facilitate the control of personnel.

To channel the management of ticket holders through recognition of the vehicle's registration number.

Among others, it is a main advantage of the invention that all the activities listed hereinbefore are resolved by installing the system in public car parks for private cars without altering, but rather taking advantage of, the current processes and operational means used for their operation.

This solution allows the system that is the object of the invention to be adapted to any car park whose entrance and exit controls are carried out by means of tickets, whether these have a magnetic band or not, retaining the dispensing and reading devices of the same, as well as the barriers and other conventional accessories of car park equipment.

2. Description of the Prior Art

Conventional management systems of public car parks base their management on the dispensing and reading of tickets on which the date and time of entry are recorded or printed, without associating them at any point in the process with the vehicle for which they have been dispensed.

These conventional systems carry out their work of ticket dispensing and reading efficiently but, lacking individualized tracking functions for each vehicle that enters the car park, they cannot detect vehicle theft, mischief on the part of employees and fraud on the part of users.

SUMMARY OF THE INVENTION

After installation of the hardware and software components that comprise it, the invention allows the objectives mentioned hereinbefore to be achieved by means of utilities and functions that allow:

Prevention of fraudulent dispensing of tickets.

Resolution of problems generated by tickets being mislaid.

Detection of attempts at vehicle theft.

Management of ticket holders without the need to give them magnetic cards.

Knowledge of which vehicles are inside at any time.

Preparation of individualized statistics.

Detection of the transit of unwanted vehicles.

Automation of the management of car park use.

BRIEF DESCRIPTION OF THE DRAWINGS

Hereinafter we provide a more extensive idea of the essential characteristics of the invention when we refer to the sheets of drawings that accompany this descriptive statement in which, somewhat diagrammatically and only by way of example, the preferred details of the invention are represented.

In the drawings.

DETAILED DESCRIPTION OF A PREFERRED EMBODIMENT

Figure 1:
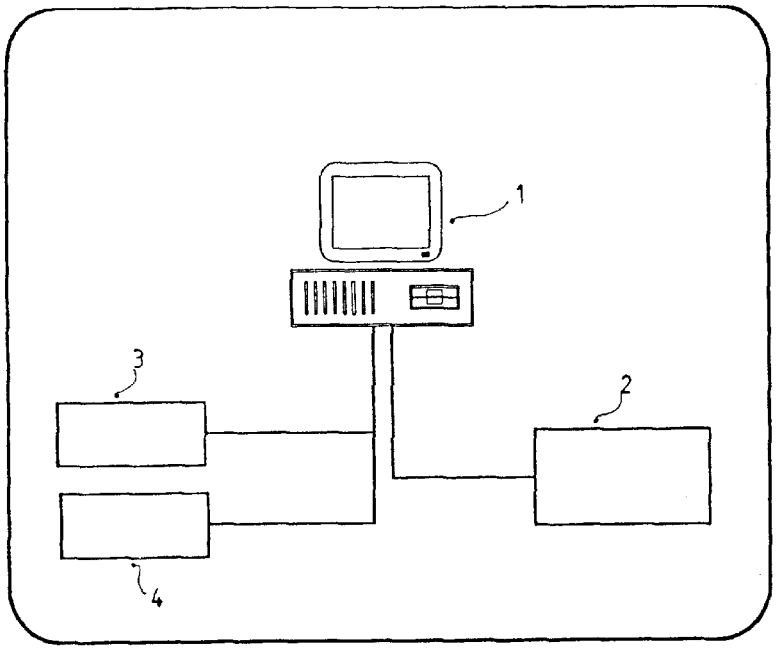
FIG. 1 schematically shows the interconnections between the several computer processors of the invention.
Figure 3:
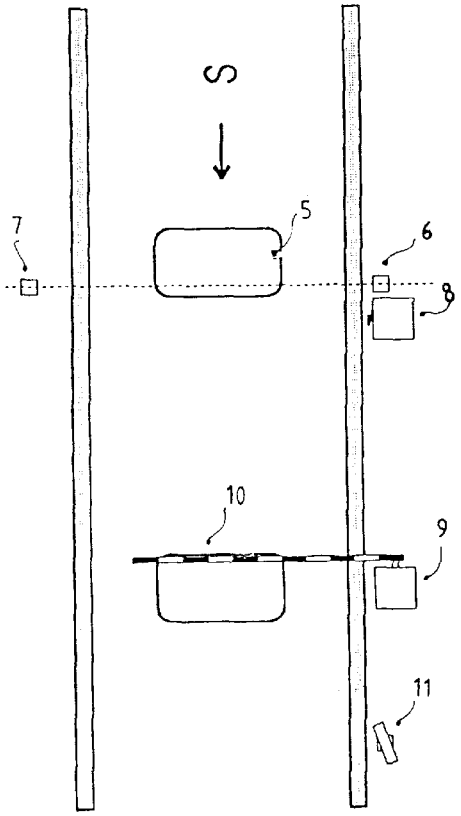
FIG. 3 is a schematic plan view showing the exit lane leading from a parking facility.

The invention consists of the installation of a system based on the association of the vehicle's registration number with the ticket collected by the driver upon entering.

The registration-number may be incorporated into the system manually (by means of a keyboard) or automatically by means of an automatic registration number reader (LAM).

The ticket number or code is inseparably associated with the vehicle's registration number and permanetly controlled by the system throughout the vehicle's stay in the car park.

The ticket code or number may be made up of a series that is independent of the registration number or it may contain it in part or whole. The registration number itself may even be used as a ticket code or number.

The ticket code or number may be present in the ticket in printed, magnetic or bar code form, or any other form, being the main characteristic of the ticket code or number, which is unique and individual for earch of those used in the car park.

The association treatment of registration number and identification number or code of credit cards or ticket holders is analogous to that described in the case of the tickets.

The ticket number or code is inseparably associated with the vehicle's registration number and permanently controlled by the system throughout the duration of the vehicle's stay in the car park.

The system is made up of cameras and devices for capturing the vehicle's frontal image, hardware and software for automatically reading registration numbers (as the case may be) and the hardware and software necessary to carry out the individualized tracking of each vehicle through the computerized management application of the car park, specifically developed to achieve the objectives mentioned hereinbefore.

The system works in real time associating the ticket number with the vehicle's registration number, with the image or images of the same and, optionally, with that of the driver taken at the time the ticket is dispensed.

If the entrance information (read registration number and dispensed ticket) coincides with the exit information (read registration number and used ticket), the vehicle's exit is automatically authorised. If it does not coincide, the system requests the intervention of the attendant.

PROBLEMS RESOLVED BY THE SYSTEM

The problems solved by installing the SYSTEM are the following:

Preventing the fraudulent dispensing of tickets: it prevents the use of a fraudulently obtained ticket for one of the following purposes:

Removing a vehicle that has remained inside for a prolonged period of time, having paid for only a fraction of the time.

Stealing a vehicle from inside the car park.

Claiming theft of a vehicle that never entered the car park.

The time of detection of the incident varies according to the mode of detection:

Standard mode: Detection at exit, because the number of the ticket does not coincide with the registration number.

Special mode: Detection at entry, because if the coil is activated by the presence of a metallic object, the registration number cannot be read. In the case of a user who takes a ticket with a vehicle, advances to the transit coil and goes back to collect another ticket with the same vehicle, this is detected when an attempt is made to dispense the second ticket, as the registration number appears inside.

Figure 6:
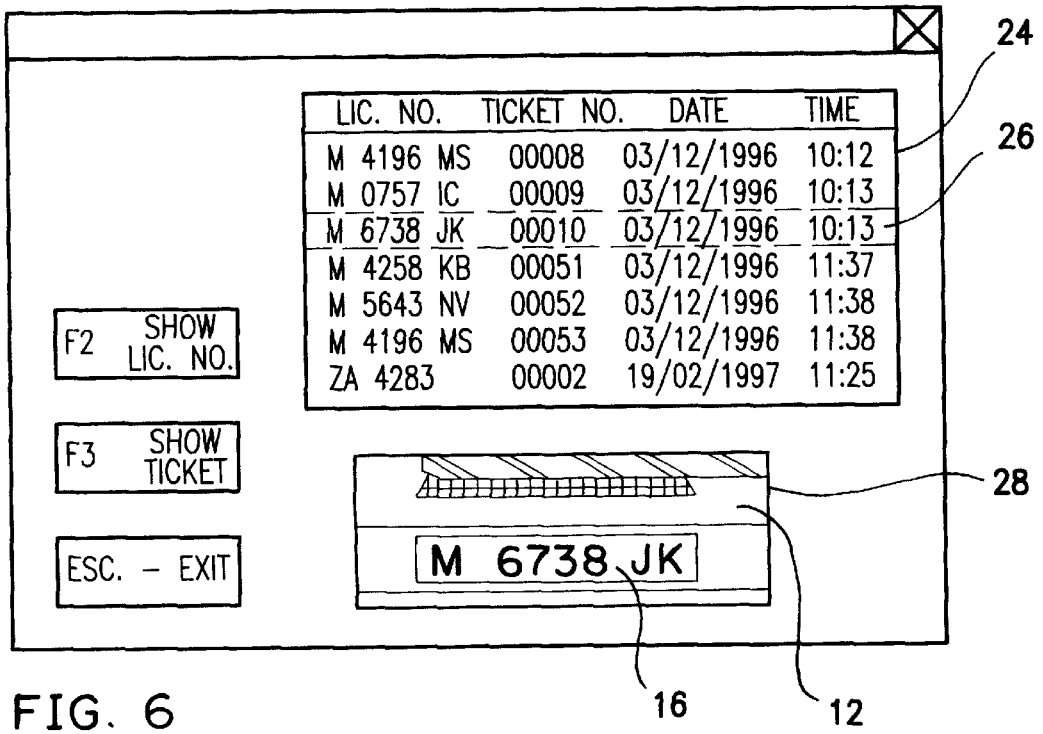
FIG. 6 is a view of a computer terminal displaying a record of vehicle license numbers that have been recorded and a frontal image of a selected vehicle; and, FIG. 7 is a view of a computer terminal displaying a record of vehicle license numbers that have been recorded and an image of the driver of a selected vehicle.

Resolving the problem of mislaid tickets: When a user mislays the ticket, his vehicle may be localized through the system by means of searching for the registration number, or the date and time of entry. In this way, in addition to greater certainty that the user is really the person who introduced the car (because these data are known), the number of the ticket that has disappeared, the time that the vehicle has been inside and the vehicle associated with this ticket are also known at the same time. The screen associated with the localization of the vehicle whose ticket has been mislaid is shown in FIG. 6. All the vehicles that are inside the car park appear arranged in order of entry. When one scrolls up or down the list, the associated images may be viewed. A search may be carried out directly by registration number or by ticket number.

The exit of a vehicle without a ticket is also recorded as an incident.

Detecting an attempt to steal a vehicle and recording any incident: If somebody attempts to leave the precincts with a stolen car, the system will be alerted before authorizing the exit, as the ticket number will not coincide with that assigned to the vehicle's registration number. In the event of a user losing his ticket, no one will be able to use it to steal the vehicle, as they will not know to which vehicle it belongs.

Logically, users must be warned not to exchange tickets and not to leave them inside the vehicle. This warning, in itself, constitutes a dissuasive weapon.

The exit of a vehicle that does not fulfill the requirements (payment, checking of the ticket-registration number, etc.), is recorded as an incident. The association of the incidents with their images makes possible a rapid and convenient monitoring of the same.

Management of ticket holders without magnetic cards: The management of ticket holders based on the reading of the registration number prevents all the problems associated with the dispensing, maintenance and control of the cards. The application is equipped with the utilities that allow access authorization by means of manual operation, in cases of reading error or when a ticket holder enters with a vehicle different from their usual one. These utilities are personalized according to the characteristics of each installation.

Knowing which vehicles are inside: The database of the vehicles that are inside allows one to know, in addition to how many vehicles are inside at any given time, which vehicles these are and how long each of them has been inside. This information is not available with a conventional system, as the tickets are in the users' possession and, moreover, there is no relation between ticket and vehicle.

Individualized statistics: The system generates individualized records that are very useful to those responsible for running the facility, providing them with information that allows them to adopt the most appropriate commercial policy according to the usual hours of use of each user. For each vehicle or each group of vehicles information is available concerning the average parking time, periodicity of car park use, most common days of the week, etc.

Detecting the transit of unwanted vehicles: The option is made possible of alerting the attendant when a vehicle belonging to a database of black-listed vehicles attempts to enter or leave the car park.

In relation to the said drawings, the first diagram shows the computer terminal (1), connected to the central unit of the operation system (2) and to the entrance (3) and exit (4) processors.

Figure 2:
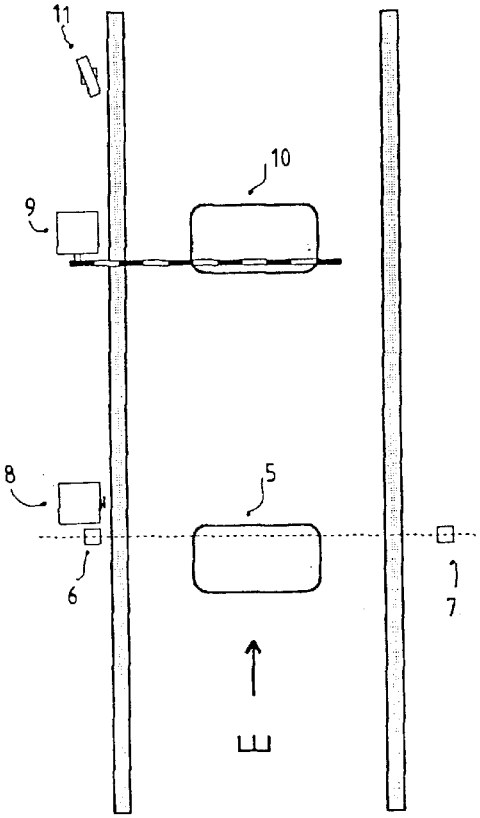
FIG. 2 is a schematic plan view showing the entrance lane leading into a parking facility.

In entrance process (E) (FIG. 2) the magnetic coil for detecting transit (5) takes part, together with the photocell that emits infrared rays (6) with its corresponding mirror (7), the ticket dispenser (8) and the camera (11).

The barriers are indicated by (9), and (10) indicates the magnetic detection coils.

In exit process (S) devices analogous to those of entrance (E) take part, except that, instead of a ticket dispenser, a ticket reader is required (8A).

Figure 4:
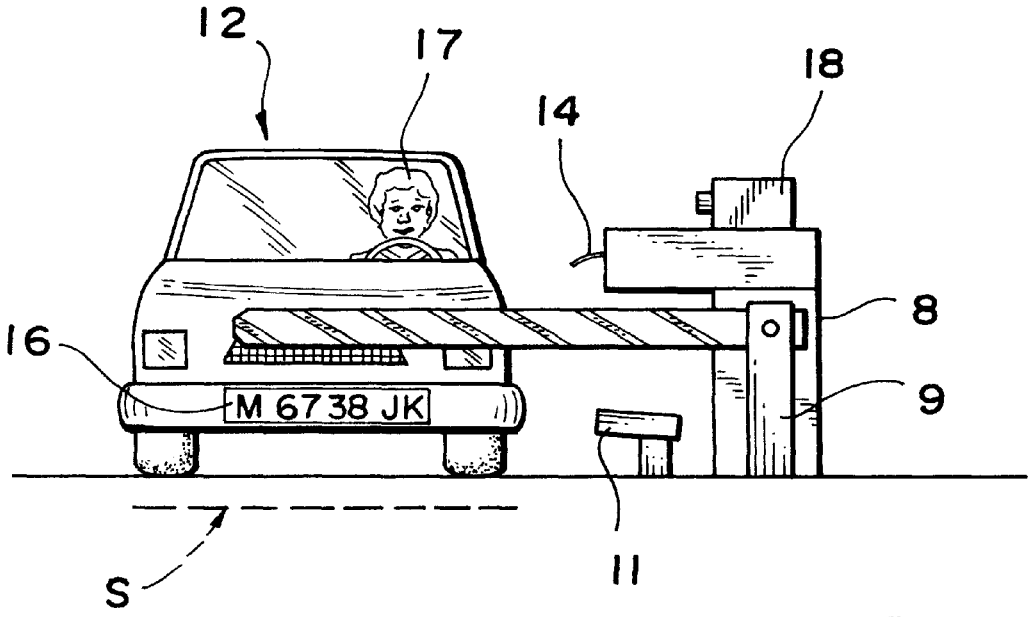
FIG. 4 is a front elevational view of a vehicle stopped before the ticket dispenser in the entrance lane of FIG. 2.

The operation of the system of the present invention will now be described. As shown in FIG. 4, when a vehicle 12 approaches barrier 9 its presence is sensed by entrance coil 5 beneath the roadway. This causes ticket dispenser 8 to dispense a ticket 14 bearing a particular identifier. At substantially the same time, the license number 16 of vehicle 12 is read by camera 11, and, optionally, an image of the vehicle driver 17 is captured by a second camera 18. Cameras 11 and 18 and ticket dispenser 8 are in communication with entrance processor 3. Processor 3 associates the ticket identifier with the license plate number and image of driver 17, creates a record of this information and passes the information on to central unit of the operating system 2. When the driver removes the ticket from the dispenser, barrier 9 opens to allow vehicle 12 to enter the parking facility.

Figure 5:
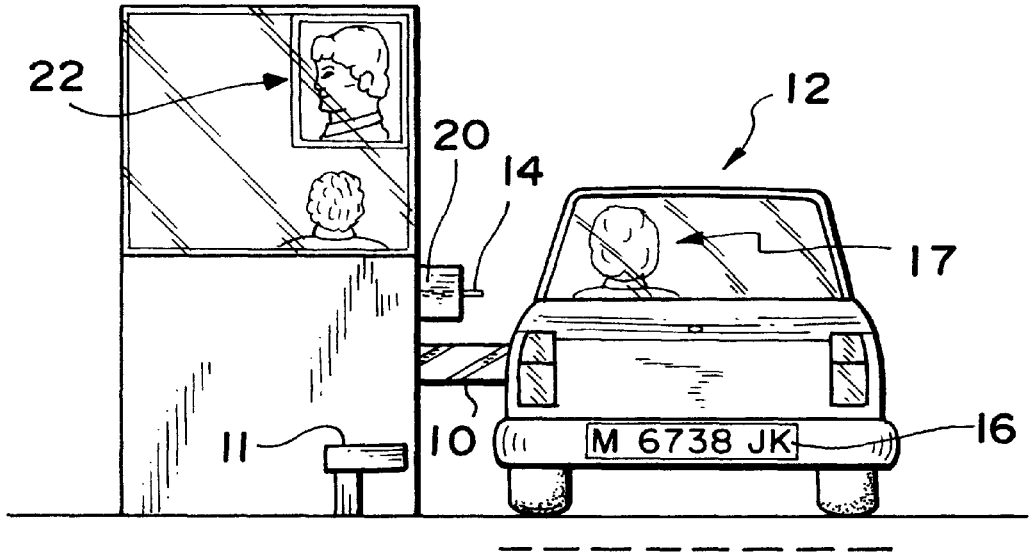
FIG. 5 is an rear elevational view of a vehicle stopped before the ticket reader in the exit lane of FIG. 3.

FIG. 5 shows vehicle 12 stopped before exit barrier 10 in exit lane S. The presence of the vehicle is sensed by exit coil 5 and causes exit camera 11 to read the license number 16 of vehicle 12. At this time, the driver 17 inserts his ticket 14 into ticket reader 20. Camera 11 and ticket reader 20 are connected to exit processor 4, and the processor determines whether the ticket 14 bears the ticket identifier associated with the license number being read. Optionally, the image of driver 17, captured when the vehicle entered the parking facility, may be displayed on a display 22 at the exit to allow an attendant to determine whether the driver leaving with the vehicle is the same driver that brought the vehicle to the facility. If the ticket identifier matches the vehicle license number, the driver pays any amount that is due, and barrier 10 is raised to allow the vehicle to exit. If the ticket identifier does not match the license number, the attendant is notified that a possible vehicle theft is occurring and that further action is needed.

Figure 7:
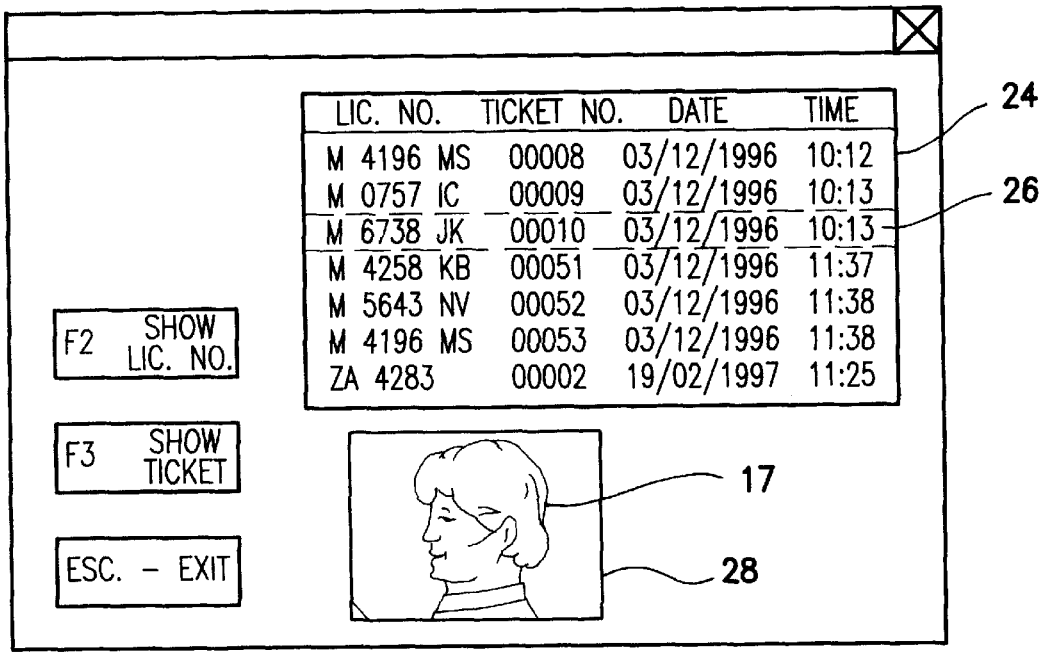

FIG. 6 shows a display representative of what may appear on computer terminal 1 when the system of the present invention is used. The display includes a top window 24 in which records for the various vehicles in the parking facility are displayed and from which a particular record can be selected. In this Figure, a record 26 has been selected which corresponds to vehicle 12 from FIGS. 4 and 5. When the record is selected, an image of the front portion of the vehicle is displayed in a lower screen window 28. Alternately, as shown in FIG. 7, lower window 28 may include an image of the driver of the vehicle associated with a particular ticket number.

The role of all these devices, which act jointly and in synchronization, is to generate and send the electrical impulses and images of registration numbers and/or frontal views of vehicles to the hardware and software components that appear in FIG. 1.

Having appropriately described the nature of the invention, for the relevant purposes it is stated that the invention is not limited to the exact details of this description, but on the contrary, modifications that are considered appropriate may be incorporated into it, provided that the essential characteristics of the invention are not altered, which are claimed hereinafter.

What is claimed is:

1. A method for controlling vehicular access to and egress from a parking facility comprising the steps of:

providing an automatically controllable entrance gate;

providing a ticket dispenser proximate to said entrance gate;

sensing for the presence of an entering vehicle at said entrance gate;

reading the license number of the entering vehicle;

providing a data processor including first memory means for storing a collection of prohibited vehicle license numbers and second memory means;

determining in said data processor whether said license number of said entering vehicle is included in said collection;

storing said license number of said entering vehicle in said second memory means;

associating a ticket identifier with said license number of said entering vehicle in said second memory means;

dispensing a ticket having said ticket identifier and opening said entrance gate when said ticket is removed from said ticket dispenser;

providing an automatically controllable exit gate;

providing a ticket reader proximate to said exit gate;

sensing for the presence of an exiting vehicle at said exit gate;

reading the license number of the exiting vehicle;

sensing for the presence of a ticket in said ticket reader and reading the ticket identifier when the presence of a ticket is sensed;

determining in said data processor whether the ticket identifier of the ticket read at the exit gate corresponds to the ticket identifier associated with the license number read at the exit gate and opening said exit gate if a correspondence is found.

2. The method of claim 1 including the additional steps of:

capturing an image of the driver of the entering vehicle;

associating in said second memory means said captured image with the license number of the entering vehicle; and displaying said captured image to an attendant at said exit gate when the license number associated with said captured image is read at the exit gate.

3. The method of claim 1 including the additional step of:

calculating the length of time between the reading of said license number at the entrance gate and the reading of said license number at the exit gate and calculating a parking charge based on said calculated length of time.

4. The method of claim 1 including the additional step of:

calculating a parking charge based on the length of time between the reading of said license number at the entrance gate and the reading of said license number at the exit gate.

5. A system for controlling vehicular access to and egress from a parking facility comprising:

an automatically controllable entrance gate;

a ticket dispenser proximate to said entrance gate;

a first sensor for sensing the presence of an entering vehicle at said entrance gate;

a first reader for reading the license number of the entering vehicle;

a data processor including first memory means for storing a collection of prohibited vehicle license numbers and second memory means for storing the license number of the entering vehicle, wherein said data processor determines whether said license number of said entering vehicle is included in said collection, associates a ticket identifier with said license number in said second memory means, and dispenses a ticket having said ticket identifier and opens said entrance gate when said ticket is removed from said ticket dispenser;

an automatically controllable exit gate;

a ticket reader proximate to said exit gate for reading the ticket identifier from a ticket inserted thereinto;

a second sensor for sensing the presence of an exiting vehicle at said exit gate; and, a second reader for reading the license number of the exiting vehicle sensed at the exit gate;

wherein said data processor determines whether the ticket identifier of the ticket read at the exit gate corresponds to the ticket identifier associated with the license number of the exiting vehicle in said second memory means and causes said exit gate to open if a correspondence is found.

6. The system of claim 5 further including a camera for capturing an image of the driver of the entering vehicle, said data processor storing said image and associating said image with said entering vehicle license number, and a display for displaying said image when the license number associated with said image is read at said exit gate.

7. The system of claim 5 wherein said data processor calculates a parking charge based on the length of time between the reading of said license number at the entrance gate and the reading of said license number at the exit gate.

8. The system of claim 5 wherein said data processor calculates the length of time between the reading of said license number at the entrance gate and the reading of said license number at the exit gate and calculates a parking charge based on said length of time.

* * * * *